US009326601B2

(12) United States Patent
Gupta

(10) Patent No.: US 9,326,601 B2
(45) Date of Patent: May 3, 2016

(54) MODULAR STORAGE AND DISPLAY SYSTEM

(71) Applicant: Anil Gupta, Pittsburgh, PA (US)

(72) Inventor: Anil Gupta, Pittsburgh, PA (US)

( * ) Notice: Subject to any disclaimer, the term of this patent is extended or adjusted under 35 U.S.C. 154(b) by 366 days.

(21) Appl. No.: 13/826,481

(22) Filed: Mar. 14, 2013

(65) Prior Publication Data

US 2013/0233818 A1 Sep. 12, 2013

Related U.S. Application Data

(63) Continuation-in-part of application No. 13/413,895, filed on Mar. 7, 2012, now Pat. No. 8,720,704.

(51) Int. Cl.

| | |
|---|---|
| ***A47B 57/42*** | (2006.01) |
| ***A47B 73/00*** | (2006.01) |
| ***A47B 47/02*** | (2006.01) |

(52) U.S. Cl.

CPC ..... *A47B 73/00* (2013.01); *A47B 47/022* (2013.01); *A47B 57/42* (2013.01)

(58) Field of Classification Search

CPC ..... A47B 47/022; A47B 57/42; A47B 73/00
See application file for complete search history.

(56) References Cited

U.S. PATENT DOCUMENTS

| | | | | |
|---|---|---|---|---|
| 1,188,146 | A * | 6/1916 | Bogley | 211/74 |
| 5,137,158 | A * | 8/1992 | Brockway | B60R 7/02 211/106.01 |
| 5,429,252 | A * | 7/1995 | Liu | 211/94.01 |
| 5,975,314 | A * | 11/1999 | Lee | 211/13.1 |
| 6,318,569 | B1 * | 11/2001 | Rothing | A47B 96/027 108/152 |
| D497,526 | S * | 10/2004 | Sanders et al. | D7/707 |
| 6,981,597 | B2 * | 1/2006 | Cash | A47B 73/008 211/74 |
| 2004/0020885 | A1 * | 2/2004 | Newman | 211/90.01 |
| 2004/0188364 | A1 * | 9/2004 | Reid et al. | 211/45 |
| 2007/0175842 | A1 * | 8/2007 | Shieh | 211/88.04 |
| 2008/0203040 | A1 * | 8/2008 | Kologe | 211/103 |
| 2009/0223912 | A1 * | 9/2009 | Chen | 211/48 |
| 2010/0006523 | A1 * | 1/2010 | Hogeback | 211/74 |
| 2011/0036791 | A1 * | 2/2011 | Huang | 211/74 |
| 2011/0204014 | A1 * | 8/2011 | Miller et al. | 211/90.01 |
| 2013/0270207 | A1 * | 10/2013 | Wang | 211/123 |

FOREIGN PATENT DOCUMENTS

| | | | | |
|---|---|---|---|---|
| EP | 1927299 | A1 * | 6/2008 | A47B 73/00 |
| WO | WO 2011092114 | A1 * | 8/2011 | |

* cited by examiner

*Primary Examiner* — Joshua Rodden
(74) *Attorney, Agent, or Firm* — James Ray and Assocs; Alexander Pokot

(57) ABSTRACT

The present invention provides a modular system for at least one of displaying and storing at least one article. The modular system includes at least a pair of elongated support brackets having magnetic protrusions; at least one elongated cross member having downwardly facing end stops and means for positioning each of the at least one elongated cross member and the at least said pair of elongated support brackets in a generally horizontal plane during use of the modular system. The at least a pair of elongated support brackets are disposed in a spaced apart parallel relationship with each other. The at least one elongated cross member is sized to at least span a distance between the at least pair of elongated support brackets. Additionally, the at least one elongated cross member may at least rest on a top edge of each of the at least the pair of elongated support brackets during use of said modular system.

15 Claims, 9 Drawing Sheets

MODULAR STORAGE AND DISPLAY SYSTEM

CROSS-REFERENCE TO RELATED APPLICATIONS

This application is a Continuation-In-Part of U.S. patent application Ser. No. 13/413,895 filed Mar. 7, 2012, pending.

FIELD OF THE INVENTION

The present invention relates, in general, to a modular system for at least one of displaying and storing at least one article and, more particularly, this invention relates to a modular system for at least one of displaying and storing wine bottles.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known traditional wine racks stored bottles of wine in square or circular compartments, to maximize the number of bottles that could be stored against a wall. These compartments extended orthogonally from the wall such that wine bottles were inserted base first, with only the mouth and cork of the bottle visible from the outside. This was problematic to a person trying to select a wine bottle from such a rack, because the label which distinguishes one wine bottle from another is on the body of the bottle, not at the mouth and cork.

Another problem with traditional wine racks is that they were not modular. Typical wine racks were built in large units that covered entire walls. This led to much wasted space for users who did not have enough wine to fill the rack. Modular wooden racks using dowels to create a rack enable the same kind of storage with bottles orthogonal to a wall with only the corks readily visible. However, this assembly method allowed as much wine rack as was needed for the available space.

Subsequent art in the wine rack field disclosed racks made of wood, wire, or metal. Some were modular, but others were decorative, with a predetermined number of storage spaces. These racks offered several advantages. The racks were cheaper to produce, lightweight, portable, and easy to install. However, these racks persisted in storing the wine orthogonal to the viewer. These iterations of wine racks did not solve the key problem of making the label visible to a viewer while the bottle was still in the rack.

All of the prior art racks and storage systems, to the best knowledge of the inventor, failed to enable display of wine bottles in combination with their storage and further enable display and/or storage of wine glasses, decanters and the like wine paraphernalia. Therefore, there is a need for an improved modular system for storing and displaying wine bottles and similarly elongated articles, for example, oil bottles, shampoo and/or conditioner bottles and containers and even shoes.

SUMMARY OF THE INVENTION

The invention provides a modular system for displaying and storing at least one article. The modular system for at least one of displaying and storing at least one article includes at least a pair of elongated support brackets, at least one elongated cross member and means for positioning each of the at least one elongated cross member and the at least the pair of elongated support brackets in generally horizontal plane during use of the modular system.

The pair of elongated support brackets may be disposed in a spaced apart parallel relationship with each other. Additionally, each support bracket may include an elongated body; a first end configured for attachment to a mounting member employed within the modular system; and at least one magnetic protrusion extending from a top edge of the bracket.

The magnetic protrusion may be comprised of any material or object that produces a magnetic field and may be formed integrally to the body of the bracket or alternatively, may be affixed to the body of the bracket mechanically or with an adhesive agent such as glue or paste.

The magnetic protrusion magnetically adheres with an outer edge of the elongated cross member such that the at least one elongated cross member is restrained from movement along the longitudinal axis of the bracket.

The at least one elongated cross member of the modular system may be sized to at least span a distance between the pair of elongated support brackets. The at least one elongated cross member may rest on a top edge of each of the pair of elongated support brackets during use of the modular system.

The at least one cross member may have a pair of downwardly facing end stops disposed on a bottom edge of the elongated body such that the end stops extend beyond the plane of the elongated body and are positioned on the outer edge of the elongated support brackets thereby preventing movement of the at least one cross member normal to the direction of the elongated support bracket.

One embodiment of the present invention provides that the at least one elongated cross member includes a cavity defined on one surface thereof throughout the length of the at least one elongated cross member. The cavity may have a concave shape in a direction normal to the length of the cross member. The concave shape may be sized such that the at least one article is at least partially disposed within the cavity and thereby restrained from movement past the longitudinal edges of the elongated cross member. The cavity may be also configured to define a generally U-shape cross-section of the elongated cross member.

An alternative embodiment of the present invention provides that the at least one elongated cross member is a pair of elongated cross members and the magnetic protrusion is at least a pair of magnetic protrusions spaced apart in relationship with each other. The at least a pair of magnetic protrusions fixes the pair of elongated cross members in a spaced apart parallel relationship with each other by magnetically connecting to an outer surface of the elongated cross members. The pair of elongated cross members position a length of the at least one article generally normal to the pair of elongated cross members, whereby one end of the at least one article is supported on one of the elongated cross members and another end of the at least one article is supported on another one of the pair of elongated cross members. The pair of elongated cross members positioned by the pair of magnetic protrusions orient a length of the at least one article along lengths of the pair of elongated cross members, wherein one longitudinal edge of each of the pair of elongated cross members abuts a surface of the at least one article.

In yet another embodiment of the present invention, the at least one article is a plurality of articles and the elongated cross member further includes at least one magnetic protrusion that magnetically connects with an outer edge of the elongated cross member for positioning at least a portion of the plurality of articles at preselected distances from each other.

OBJECTS OF THE INVENTION

It is, therefore, one of the primary objects of the present invention to provide a modular system for at least one of displaying and storing at least one article. The modular system includes at least a pair of elongated support brackets; at least one elongated cross member; and means for positioning each of the at least one elongated cross member and the at least the pair of elongated support brackets in generally horizontal plane during use of the modular system. The elongated brackets include an elongated body; a first end configured for attachment to a mounting member employed within the modular system; and at least one magnetic protrusion extending from a top edge of the bracket. The elongated cross member includes a pair of downwardly facing end stops disposed on a bottom edge of the elongated body. The at least one elongated cross member includes a cavity defined on one surface thereof throughout the length of the at least one elongated cross member, whereby the cavity may have a concave shape in a direction normal to the length of the cross member, whereby the concave shape may be sized such that the at least one article is at least partially disposed within the cavity and thereby restrained from movement past the longitudinal edges of the elongated cross member.

Another object of the present invention is to provide a modular system for at least one of displaying and storing at least one article that includes a pair of elongated cross members and a pair of magnetic protrusions spaced apart in relationship with each other.

Yet another object of the present invention provides a bracket for supporting at least one elongated cross member of a modular system for at least one of displaying and storing at least one article that includes an elongated body; a first end configured for attachment to a mounting member employed within the modular system; and at least one magnetic protrusion.

A further object of the present invention is to provide a bracket for supporting at least one elongated cross member of a modular system for at least one of displaying and storing at least one article that includes at least a pair of elongated cross members and at least a pair of magnetic protrusions in spaced apart in relationship with each other.

Yet another object of the present invention is to provide a bracket for supporting at least one elongated cross member of a modular system for at least one of displaying and storing at least one article that includes at least one elongated cross member having a cavity defined on one surface thereof throughout the length of the at least one elongated cross member.

Yet another embodiment of the present invention provides an elongated cross member for a modular system for at least one of displaying and storing at least one article, wherein the elongated cross member includes an elongated body; and a pair of downwardly facing end stops disposed.

A further object of the present invention is to provide an elongated cross member for a modular system for at least one of displaying and storing at least one article that includes a plurality of articles and at least one magnetic protrusion.

An alternative object of the present invention is to provide an elongated cross member for a modular system for at least one of displaying and storing at least one article that includes an elongated cross member with a cavity defined on one surface thereof throughout the length of the at least one elongated cross member.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
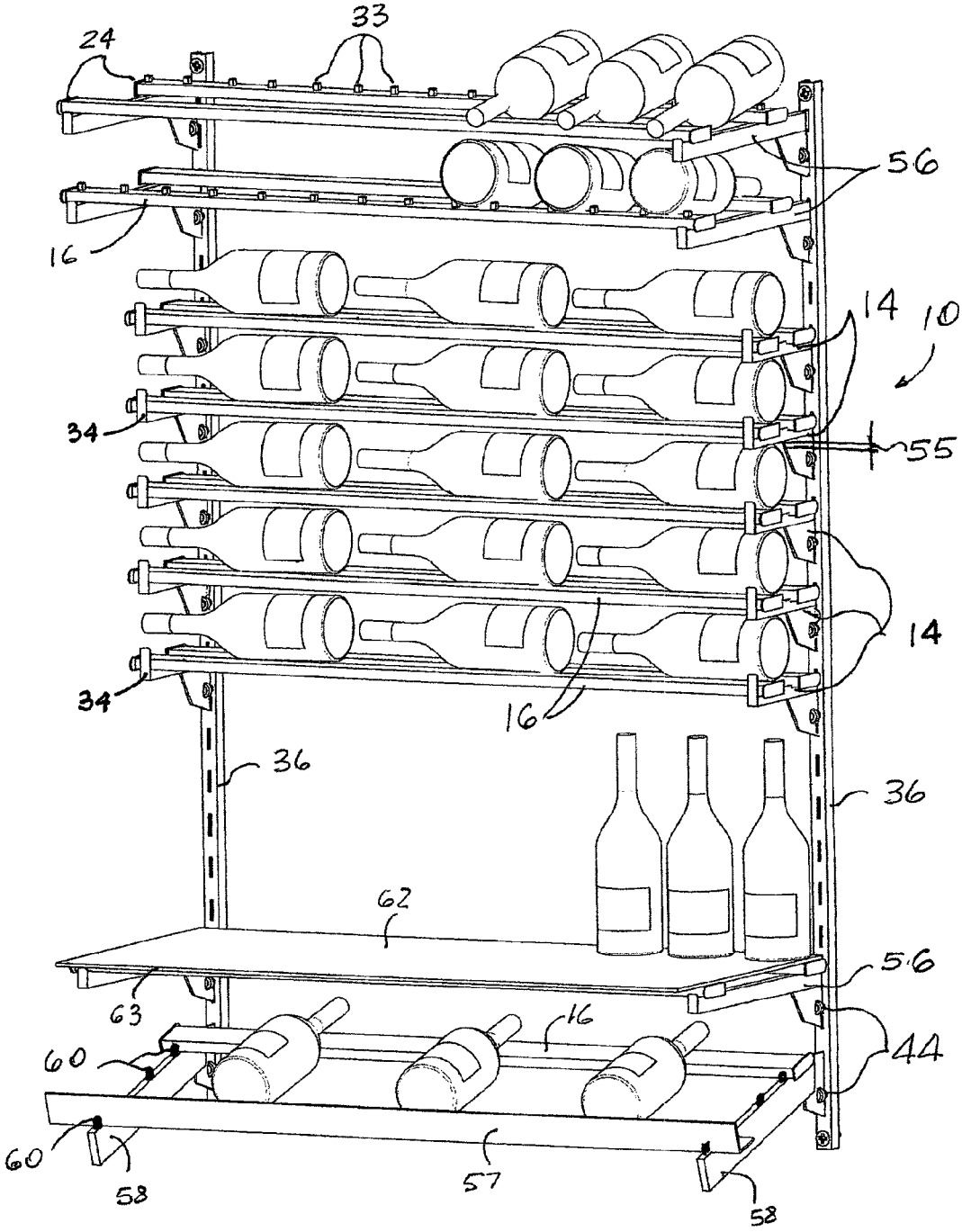
FIG. 1 is a perspective view of a modular system for storing and displaying articles.

Prior to proceeding to the more detailed description of the present invention, it should be noted that, for the sake of clarity and understanding, identical components which have identical functions have been identified with identical reference numerals throughout the several views illustrated in the drawing figures.

The best mode for carrying out the invention is presented in terms of its presently preferred embodiment, herein depicted within FIGS. 1 through 11. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The present invention describes a system for storing and displaying an article (herein described as the "system"), generally designated as 10, which provides means to store and display an article 12, particularly, wine bottles.

It is to be understood that the definition of an article 12 applies to any item that may be displayed or stored, for example bottles, such as wine bottles, liquor bottles or bottles used for cooking such as oil bottles. Additionally, the definition of article 12 may be further applied to other retail items such as shoes, purses, decorative household goods and other like items suitable for display and/or storage.

The present invention is illustrated and described in combination with a wine bottle, although it will be apparent to those skilled in the relevant art that the present invention may be applied to other bottles and articles and as such should not be interpreted as a limiting factor of the system of the present invention.

Reference is now made, to FIGS. 1-11, wherein the modular system 10 includes at least a pair of elongated support brackets 14, at least one elongated cross member 16 and means 18 for positioning each of the at least one elongated cross member 16 and the at least said pair of elongated support brackets 14 in a generally horizontal plane during use of the modular system 10.

The at least a pair of elongated support brackets 14 may be disposed in a spaced apart parallel relationship with each other. Each support bracket 14 may be of a generally tubular shape to afford weight reduction of the system 10, although other shapes are also contemplated in this document. Additionally, the at least one elongated cross member 16 is sized to at least span a distance between the at least pair of elongated support brackets 14 such that the at least one elongated cross member 16 may at least rest on a top edge 15 of each of the at least the pair of elongated support brackets 14 during use of said modular system 10.

The at least a pair of elongated support brackets 14 and the at least one elongated cross member 16 may each be made of any material, for example metal, wood or a polymeric material. In one embodiment, the at least a pair of elongated support brackets 14 and the one elongated cross member 16 are comprised of chrome plated steel.

Figure 3:
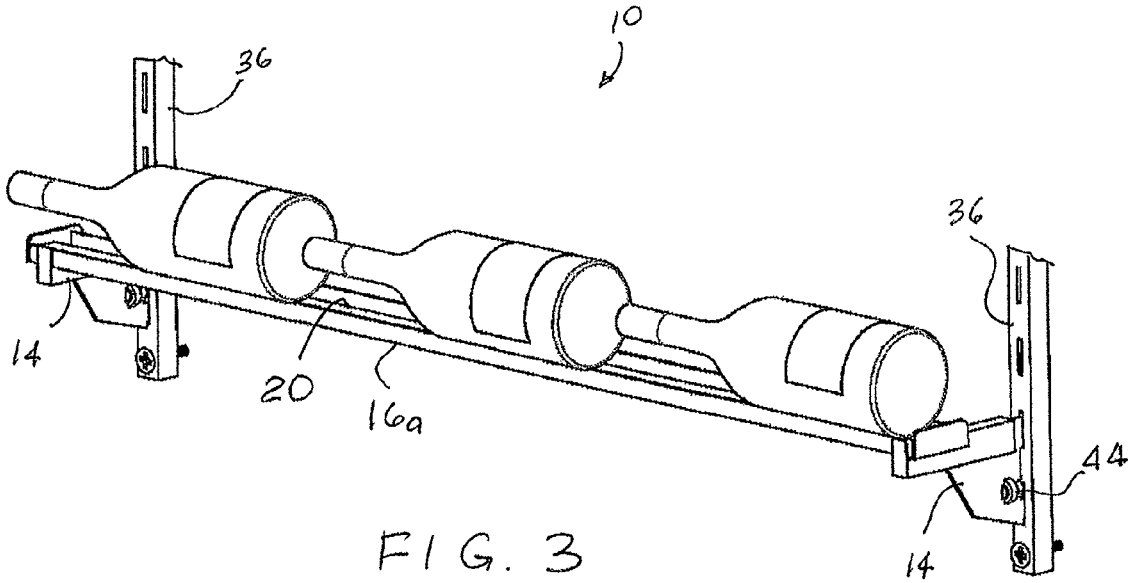
FIG. 3 is a partial perspective view of the system of FIG. 1, particularly illustrating a single elongated crossmember.

In one embodiment of the present invention, as seen in FIG. 3, the at least one elongated cross member 16*a* may include a cavity 20 defined in one surface thereof throughout the length of the at least one elongated cross member 16*a*. The cavity 20 may have a concave shape in a direction normal to the length of the at least one elongated cross member. Additionally, the concave shape may be sized such that the at least one article 12 is at least partially disposed within the cavity 20 and thereby restrained from movement past the longitudinal edges of the at least one elongated cross member 16*a*. The embodiment of the invention as shown in FIG. 3 provides a label view when the article 12 that is displayed and/or stored is a bottle.

Figure 2:
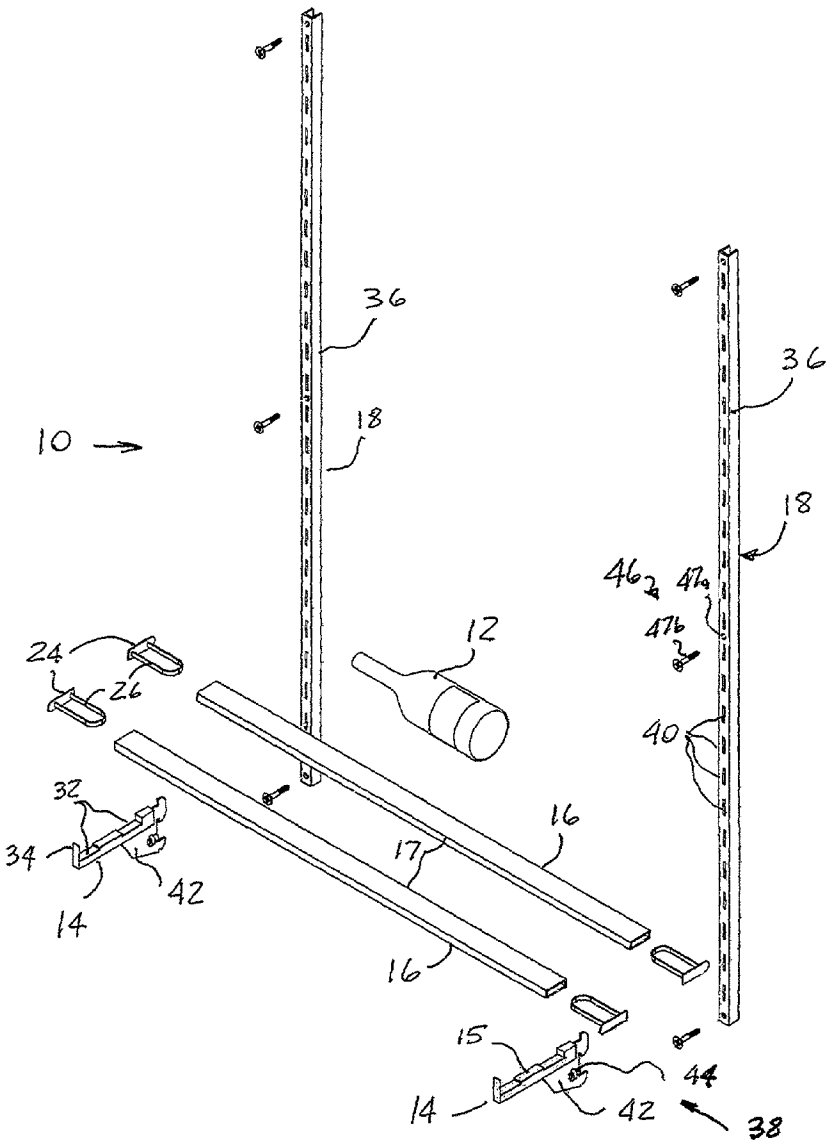
FIG. 2 is a partial exploded view of the modular system of FIG. 1.
Figure 4:
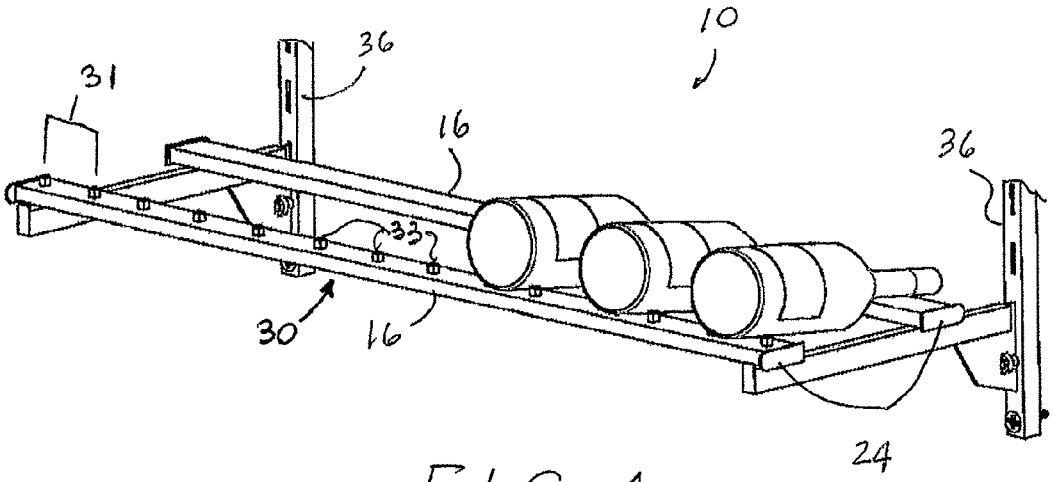
FIG. 4 is a partial perspective view of the system of FIG. 1, configured for a bottom view of articles.

As seen in FIGS. 2-4, the at least one elongated cross member 16 may be at least a pair of elongated cross members 16 disposed in a spaced apart parallel relationship with each other. Additionally, each of the at least said pair of elongated cross members 16 may include a pair of end stops 24 that are sized larger than a cross section of each of the at least said pair of elongated cross members 16 so as to prevent longitudinal movement of the articles 12 oriented in accordance with FIGS. 3 and 8. In one embodiment, each of the at least pair of elongated cross members 16 may be hollow and each of the pair of stops 24 may include a portion 26 sized and shaped for insertion into a respective hollow end. Preferably, the elongated cross members 16 are manufactured from tubular material. The pair of end stops 24 can be made of any material, for example metal, wood or a polymeric material. In one embodiment, the pair of end stops 24 are comprised of chrome plated steel.

Figure 5:
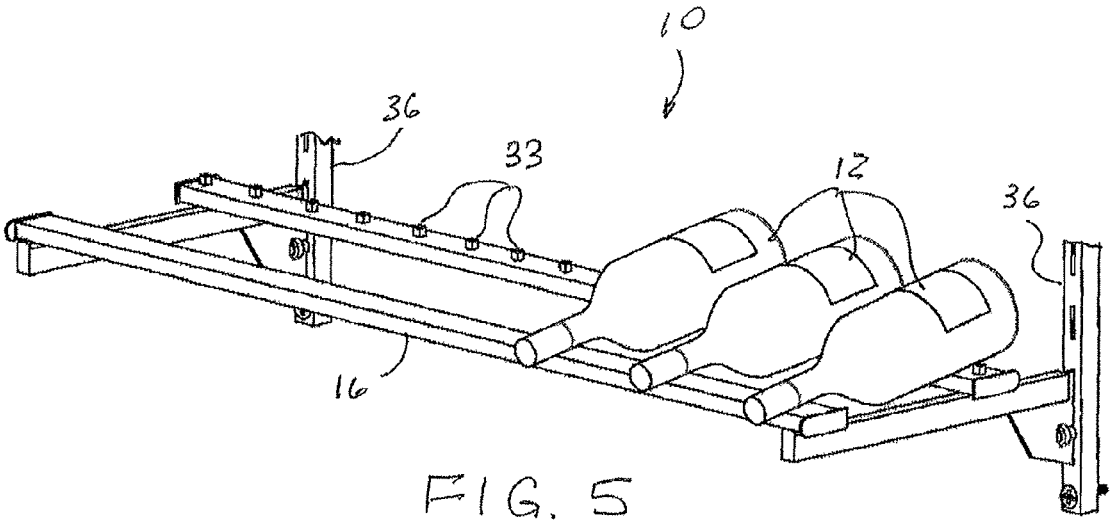
FIG. 5 is a partial perspective view of the system of FIG. 1 configured for a top view of articles.
Figure 6:
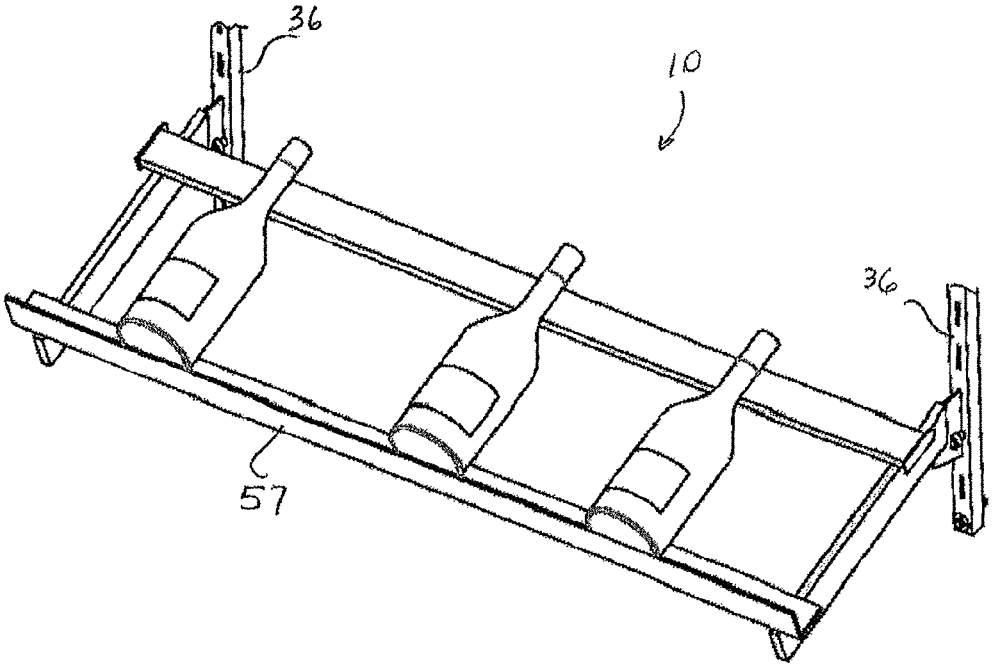
FIG. 6 is a partial perspective view of the system of FIG. 1 configured for a presentation view of articles in a generally horizontal position.

As best seen in FIGS. 4-6, the spaced apart parallel relationship of the at least said pair of elongated cross members 16 may be so configured and sized that a length of the at least one article 12 is oriented generally normal to a length of the at least said pair of elongated cross members 16. In this configuration, one end of the at least one article 12 is supported on one of said at least said pair of elongated cross members 16 and another end of said at least one article 12 is supported on another one of said at least said pair of elongated cross 16. The embodiment of the invention as shown in FIG. 5 provides a top or a cork view when the article 12 that is displayed and/or stored is a bottle.

As depicted in FIGS. 4 and 5, one embodiment of the present invention provides that the at least one article 12 may be a plurality of articles 12 and the modular system 10 may also include means 30 for positioning at least a portion of the plurality of articles 12 at preselected distances 31 from each other on at least the pair of elongated cross members 16. For example, the means 30 may include a plurality of protrusions 33 extending from a surface of at least one of the at least said pair of elongated cross members. The means 30 for positioning at least a portion of the plurality of articles at preselected distances from each other may be part of the elongated cross member 16 or alternatively may be separately constructed.

Figure 8:
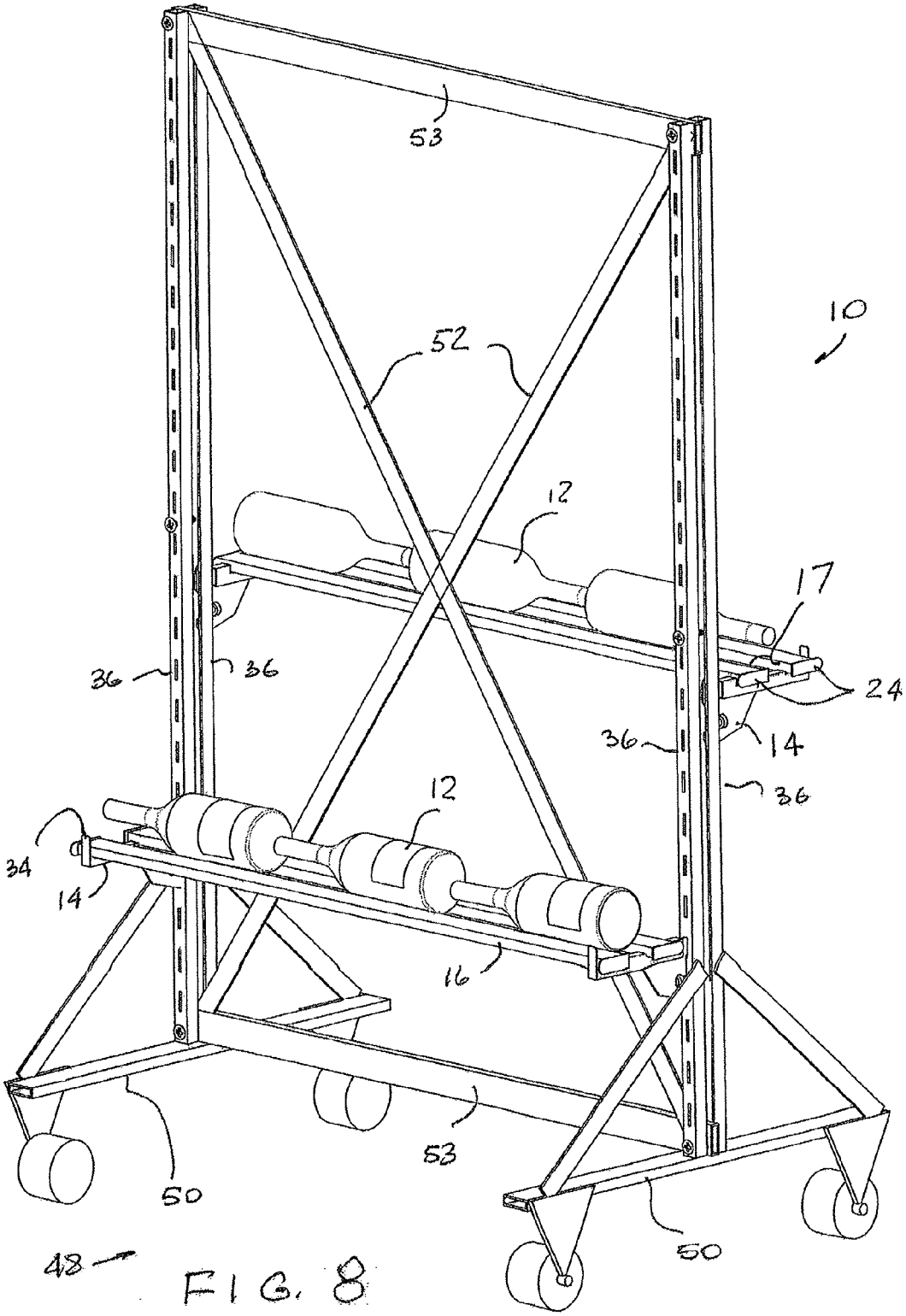
FIG. 8 illustrates a perspective view of the system of FIG. 1 configured as a free standing storage and display.

In further reference to FIGS. 1-2 and 8, the spaced apart parallel relationship of the at least said pair of elongated cross members 16 is so configured and sized that a length of said at least one article 12 is oriented along a length of said at least said pair of elongated cross members 16. In this embodiment, one longitudinal edge 17 of each of the at least said pair of elongated cross members 16 abuts a surface of the at least one article 12. In an alternative embodiment, the bracket 14 may be elongated such that it can accommodate additional cross members 16 and thereby hold multiple rows of articles 12.

Figure 7:
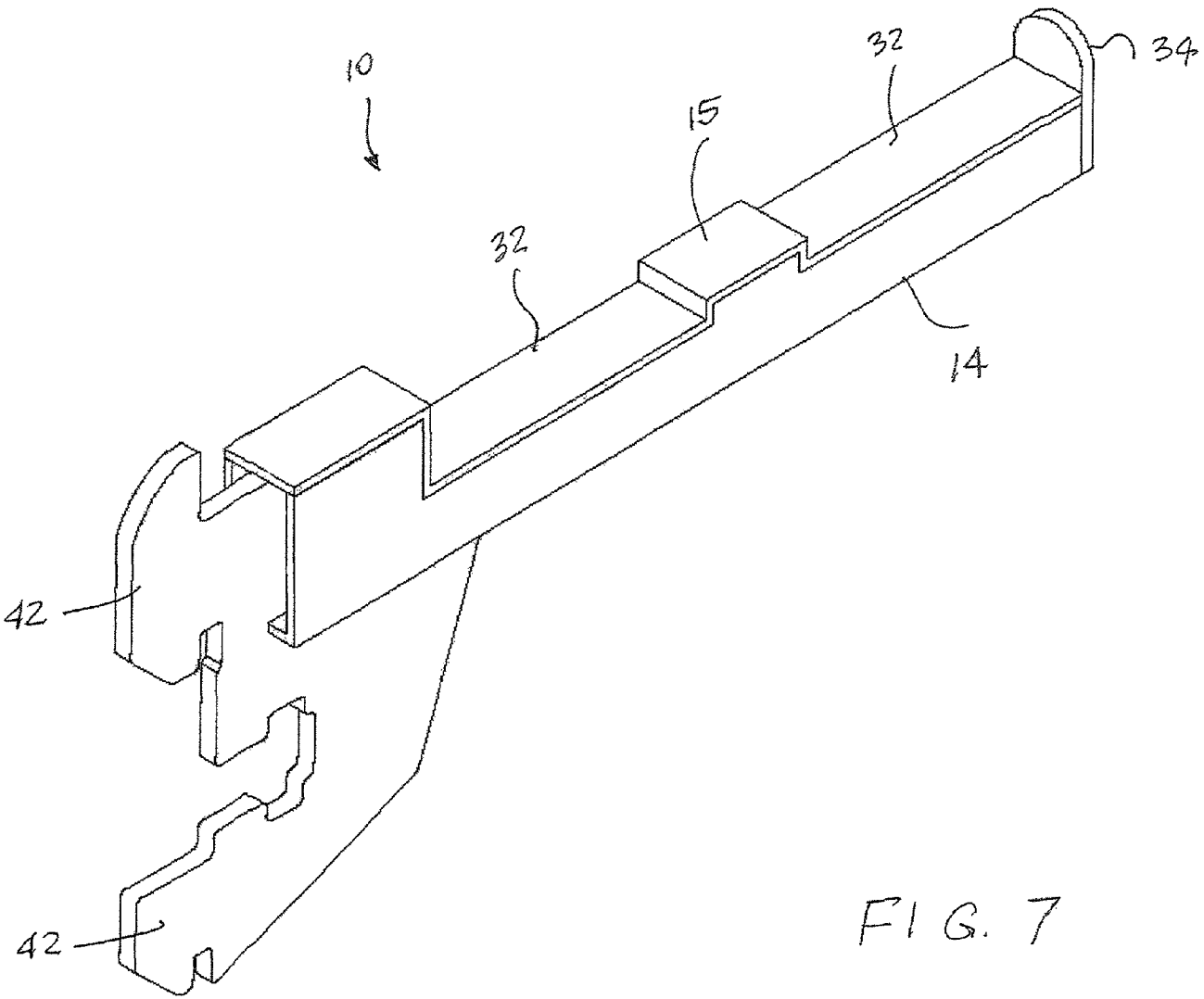
FIG. 7 illustrates a perspective view of a support bracket utilized with the system of FIG. 1.

As best seen in FIGS. 1 and 7, the modular system 10 may also include means 32 for at least temporarily fixing the at least said pair of elongated cross members 16 disposed generally horizontally in said spaced apart parallel relationship with each other. As shown in FIG. 7, the means 32 may include a pair of cavities defined in the top edge 15 of each of the at least said pair of said brackets 14. Alternatively, the means 32 may include a plurality of the above described protrusions 33 extending from the top edge 15 of each of the at least pair of the brackets 14. It would be understood that the bottom edge of the pair of cavities 32 may define the top edge of the bracket 14, essentially replacing the cavities 32 with abutment containing the top edge 15 of FIG. 7.

In one embodiment, the system 10 includes a stop 34 disposed on a longitudinally opposite end of each of the at least pair of elongated support brackets 14. A portion of the stop 34 may protrude above the top edge 15 of each of the at least pair of elongated support brackets. The stop 34 may be an integral part of each of the at least pair of elongated support brackets 14 or alternatively may be separately constructed.

The positioning means 18 of the modular system 10 may include at least a pair of elongated mounting members, 36, conventionally referred to as "standards" that are disposed generally vertically in a spaced apart parallel relationship with each other during use of the modular system 10. The modular system 10 may further include means 38 for attaching one end of each elongated support bracket 14 to a respective elongated mounting member 36. For example, as seen in various figures, the attaching means 38 may include a plurality of apertures or cavities 40 defined in each of the at least the pair of elongated mounting members 36 in a spaced apart relationship with each other along a length thereof and at least one tab 42 extending from the one end of each of the at least the pair of elongated support brackets 14. The at least one tab 42 is sized and shaped for insertion into one of the plurality of apertures or cavities. The at least one tab 42 may be an integral part of each of the at least pair of elongated support brackets 14 or alternatively may be separately constructed.

The mounting members 36 may be made of any material, for example metal, wood or a polymeric material. In the presently preferred embodiment, mounting members 36 are comprised of chrome plated steel.

Additionally, the attaching means 38 may also include an optional tension mechanism 44 disposed at the one end of each of the at least the pair of elongated support brackets 44. The tension mechanism 44 may be manually operable to remove slack between the one end of each of the at least the pair of elongated support brackets 14 and a mating surface of the respective one of the at least the pair of elongated mounting members 36. In one embodiment of the present invention, the tension mechanism 44 may be a screw, nut, bolt or other like tension mechanism. In the presently preferred embodiment, the tension mechanism 44 is of the type as provided within a universal wall mount bracket from Gershel Bros. of Phoenix, Ariz.

In another embodiment, the modular system 10 comprises means 46 for securely attaching each of the at least the pair of elongated mounting members 36 to a vertical surface, for example a wall. The securely attaching means 46 may include at least a pair of apertures 47*a* formed through a thickness of each of the at least pair of elongated mounting members 36 and a plurality of screws or bolts 47*b* each sized for passage through a respective aperture 47*a*. The securely attaching means 46 may be a screw, bolt, nail or other like securely attaching means.

As seen in FIG. 8, the modular system may include means 48 for supporting the at least the pair of elongated mounting members in a free standing manner. The supporting means 48 may include at least one base member 50 to which a lower end of each of the at least the pair of elongated mounting members 36 is attached thereto. In a particular embodiment, the at least one base member 50 is at least a pair of base members 50 disposed in a spaced apart relationship with each other, each of the at least pair of base members 50 is operatively positioned at each lower end of a respective one of the at least pair of elongated mounting members 36. In further reference to FIG. 8, a pair of mounting member 36 are positioned in a back-to-back relationship with each other so as to store and/or display articles 12 on both vertical surfaces of the system 10. Optional cross braces 52 and horizontal braces 53 are also contemplated within the instant invention.

In further reference to FIG. 1, such Figure provides one example of an arrangement of the modular system 10 that comprises at least a pair of elongated mounting members 36; a plurality of elongated cross members 16; a plurality of first support brackets 14; a plurality of second support brackets 56; at least a pair of third support brackets 58; and a plurality of protrusions 60 disposed in a spaced apart relationship on a top edge of each of the at least the pair of third support brackets 58. Brackets 14, 56 and 58 preferably are similarly constructed and have identical attachment means 38.

The at least a pair of elongated mounting members 36 are disposed generally vertically in a spaced apart parallel relationship with each other during use of the modular system 10.

The plurality of first support brackets 14 each extends generally horizontally from and normal to a respective one of the at least the pair of elongated mounting members 36 and are sized so as to position at least another pair of the plurality of elongated cross members 16 in a first spaced apart parallel relationship with each other. The length of the at least one article 12 is oriented along a length of the at least another pair of elongated cross members 16. Additionally, one longitudinal edge of each of the at least another pair of elongated cross members 16 abuts a surface of the at least one article 12. The plurality of first support brackets 14 may be made of any material, for example metal, wood or a polymeric material. In one embodiment, plurality of first support brackets are comprised of chrome plated steel.

The plurality of second support brackets 56 extend generally horizontally from and normal to the respective one of the at least the pair of elongated mounting members 36 and are sized so as to position at least another pair of the plurality of elongated cross members 16 in a second spaced apart parallel relationship with each other, whereby a length of the at least one article 12 is oriented generally normal to a length of the at least one pair of elongated cross members 16, whereby one end of the at least one article 12 is supported on one of the at least one pair of elongated cross members 16 and another end of the at least one article is supported on another one of the at least one pair of elongated cross members 16. Second brackets 56 may include the above described cavities 32. The plurality of second support brackets 56 may be made of any material, for example metal, wood or a polymeric material. In one embodiment, plurality of second support brackets 56 are comprised of chrome plated steel.

In this arrangement, the apertures 40 are spaced at a preselected distance from each other and support brackets 14 and are dimensioned and sized so as to minimize clearance 55 between the surface of the article 12 and the bottom edge of the respective upper support bracket 56.

Each of the at least a pair of third support brackets 58 extends at an angle from the respective one of the at least the pair of elongated mounting members 36 so that a distal end of each of the at least the pair of third support brackets 58 is disposed lower in a vertical direction then a proximal end thereof being disposed in close proximity to the respective one of the at least the pair of elongated mounting members 36. The plurality of third support brackets 58 may be made of any material, for example metal, wood or a polymeric material. In one embodiment, plurality of third support brackets 58 are comprised of chrome plated steel.

The plurality of protrusions 60 are disposed in a spaced apart relationship on a top edge of each of the at least the pair of third support brackets 58, whereby at least a further pair of the plurality of elongated members 16 positioned in a third spaced apart parallel relationship with each other on the top edge of each of the at least the pair of third support brackets positions the at least one article 12 at an incline relative to a plane defined by the at least the pair of elongated mounting members 36. The plurality of protrusions 60 may be part of each of the at least pair of third elongated support brackets 58 or alternatively may be separately constructed. One of the pair of elongated members 16 has a lip 57 so as to restrain articles 12 from movement.

As is further seen in FIG. 1, the system 10 of this the present invention may also include a substantially planar shelf 62 disposed on top of a pair of the elongated cross members 16. Accordingly, the thickness of elongated members 16 is so selected that upper surface thereof protrudes above the top edge of the stop 34 allowing the front edge 63 of the shelf 62 to extend in a forward direction past the stops 34 if desired for a particular application. The planar shelf 62 may be made of any material, for example metal, wood or a polymeric material or glass.

The instant invention contemplates that the support bracket 14 may be adapted with three (3) cavities 32 or, alternatively, four (4) protrusions 60 so as to support and space three (3)

elongated members 16 and provide two (2) spaced apart rows of articles 12 aligned and oriented in a longitudinal direction of the elongated members 16.

The system 10 of FIG. 1 defines a rack for storage and display purposes. The instant invention further contemplates that a plurality of systems 10 of FIG. 1 can be mounted in a side-by-side relationship with each other in applications utilizing large size walls, for example as in stores, basements and the like spaces. It is further contemplates that arrangement of elongated cross members 16 may differ for each of the plurality of systems 10 so as to fit particular needs or styles of the user. For example, more than one shelf 62 may be used for tasting purposes or for storing and displaying wine glasses and decanters. Or, more than one pair of third brackets 58 may be used to display rare wine bottles. In another example, each system 10 can be arranged in accordance with FIGS. 4-5 so as to store the maximum number of articles 12 possible.

Figure 9:
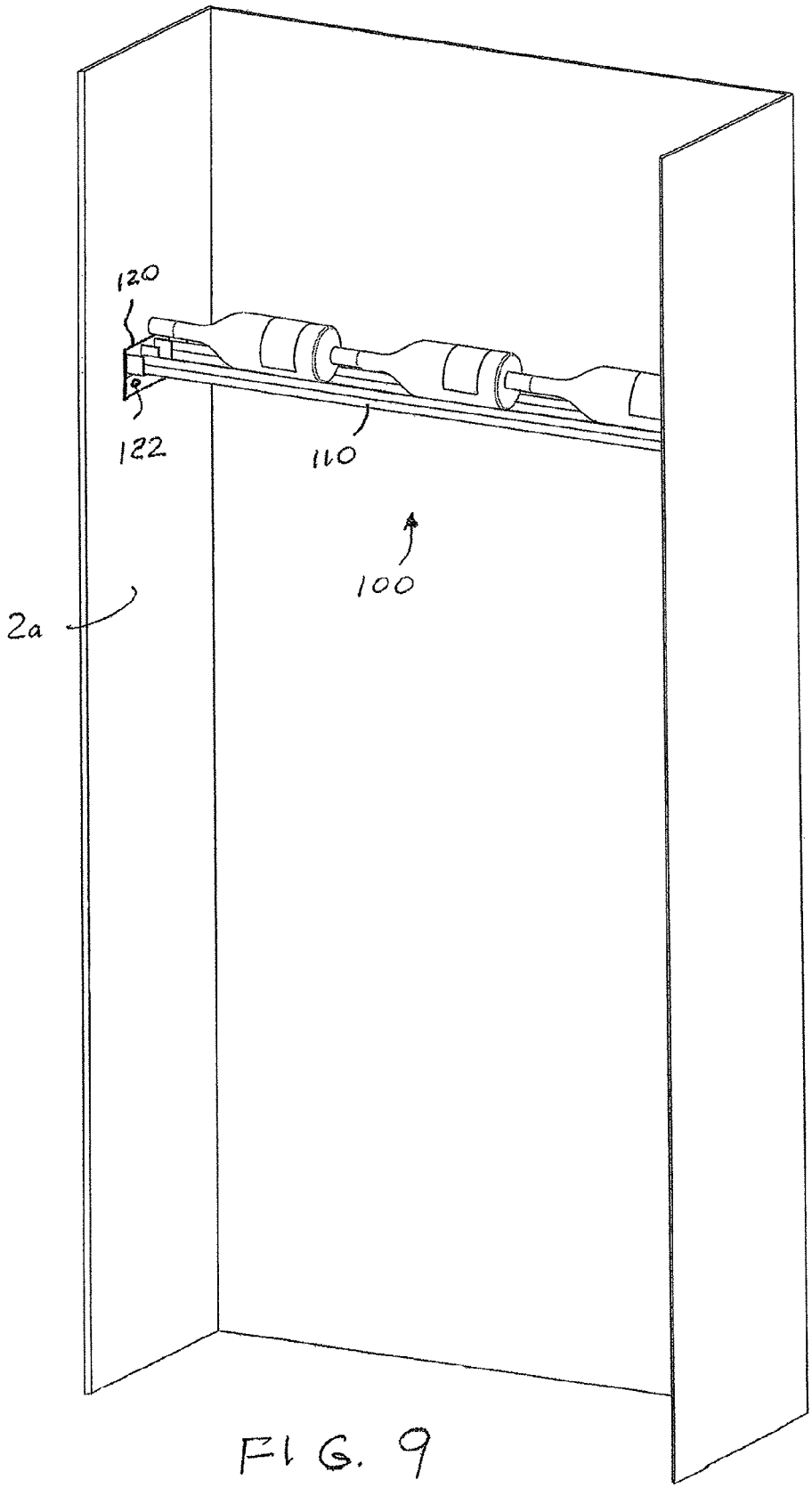
FIG. 9 illustrates a perspective view of another embodiment for storing and displaying articles.

In another embodiment, shown in FIG. 9, the instant invention contemplates a system, generally designated as 100, wherein elongated cross members 110 may be used to span the width between wall portions 2*a* without use of the standards 36. In this embodiment, the end members 24 would be enlarged, as represented by reference numerals 120, and provided with mounting apertures 122. It is further contemplated to arrange elongated cross members 110 in accordance with the above described embodiments.

Figure 10:
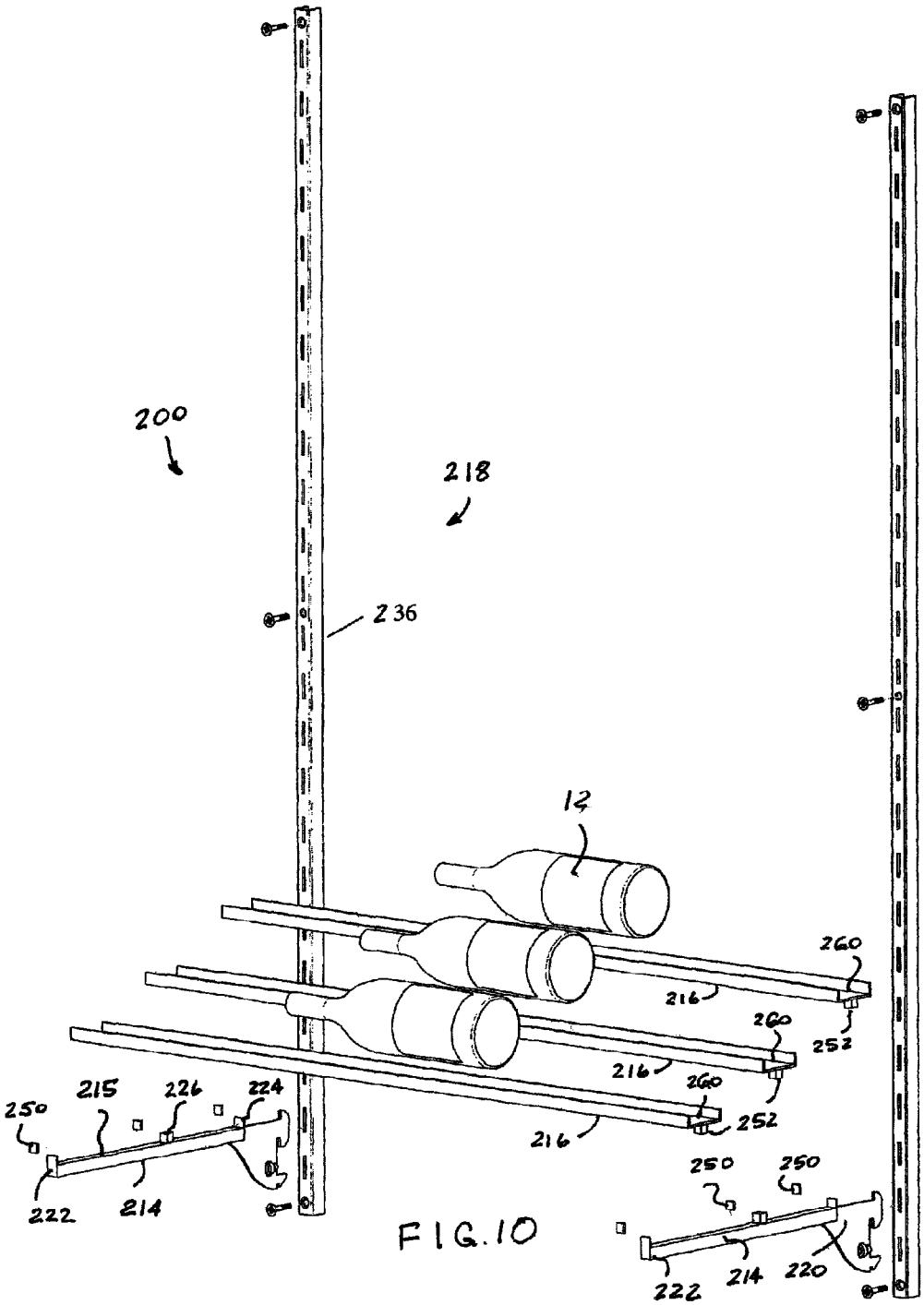
FIG. 10 illustrates an exploded view of an system of storing and displaying articles that utilizes magnetic protrusions and downwardly facing end stops.
Figure 11:
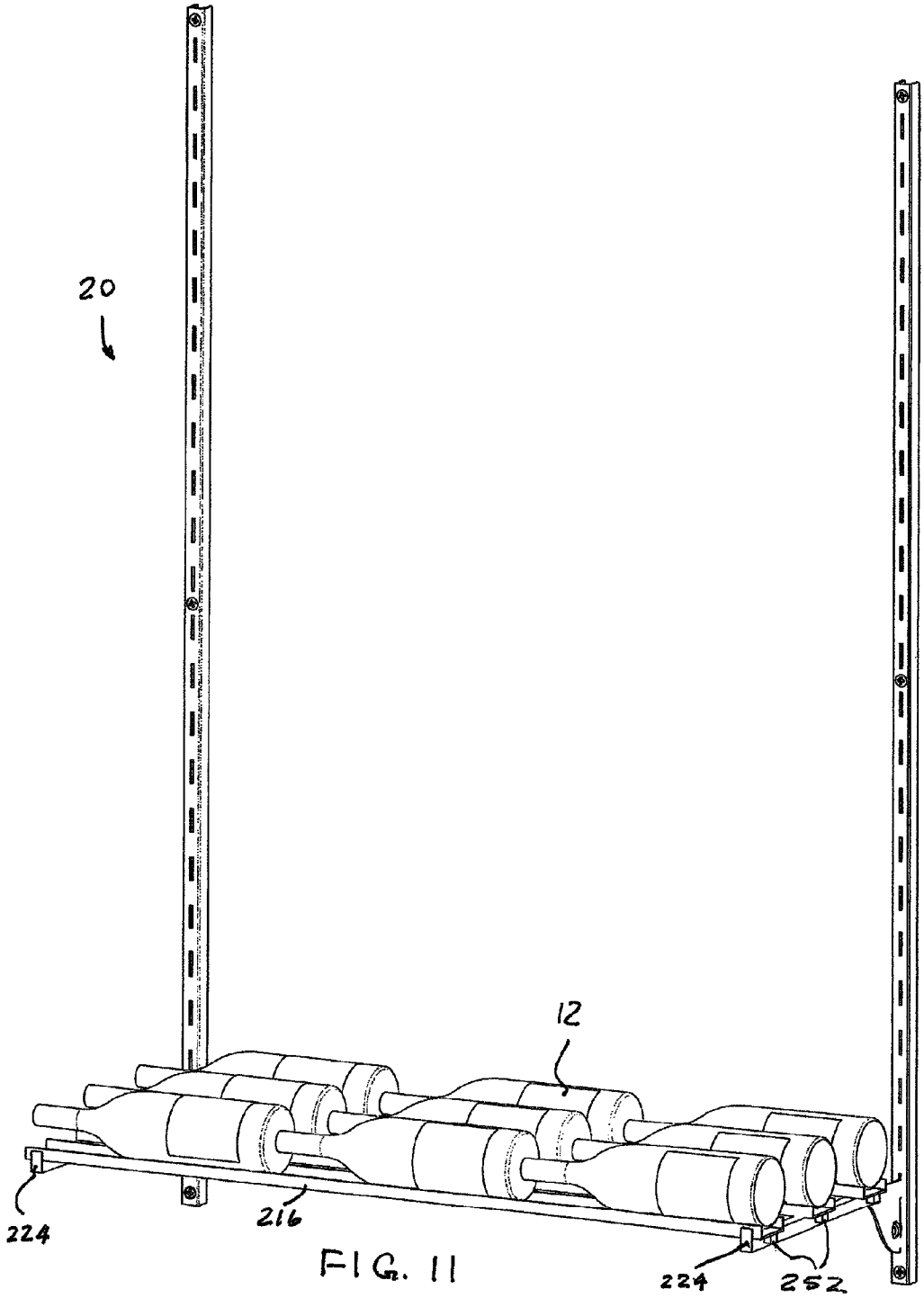
FIG. 11 illustrates a perspective view of the system of FIG. 10.

An additional embodiment of the present invention illustrated in FIGS. 10-11 is directed to a modular system, generally designated as 200, for displaying and storing at least one article 12 and includes one or more magnetic protrusions 250 on a top surface 215 of the bracket 214 and is further directed to downwardly facing end stops 252 extending from the elongated cross members 216.

Particularly, the modular system 200 for at least one of displaying and storing at least one article, of this embodiment includes at least a pair of elongated support brackets 214, at least one elongated cross member 216 and means 218 for positioning each of the at least one elongated cross member 216 and the at least the pair of elongated support brackets 214 in generally horizontal plane during use of the modular system 200. Such means 218 may be identical to above described means 18.

The pair of elongated support brackets 214 are disposed in a spaced apart parallel relationship with each other. Additionally, each support bracket 214 includes an elongated body; a first or rear end 220 configured for attachment to a mounting member 236 employed within the modular system 200 and a second or front end 222; and at least one magnetic protrusion 250 extending from a top edge 215 of the bracket 214.

The magnetic protrusion 250 may be comprised of any material or object that produces a magnetic field and may be formed integrally to the body of the bracket 214 or alternatively, may be affixed to the body of the bracket 214 mechanically or with an adhesive agent such as glue or paste. Suitable mechanical means include, but are not limited to screws, nails, bolts or other like means. An adhesive agent may be defined as a substance that unites or bonds surfaces together and may include non-reactive adhesives, reactive adhesives and natural adhesives.

The magnetic protrusion 250 magnetically abuts the outer edge of the elongated cross member 216 such that the at least one elongated cross member 216 is restrained from movement along the longitudinal axis of the bracket 214. Therefore, the elongated cross member 216 utilized in the modular system 200 shown in FIGS. 10-11 may be made of or coated with any material that interacts with a magnetic field, such as metal.

By way of an example only of FIGS. 10-11, the system 200 is illustrated as having three elongated cross members 216. Thus, the bracket 214 includes three magnetic protrusions 250. Two magnetic protrusions 250 are mounted at each end of the bracket 214, at tabs 224, and the third protrusion is mounted mediate the ends 220, 222, at a tab 226, so as to provide desired spacing for the middle elongated cross member 216.

The at least one elongated cross member 216 of the modular system shown in FIGS. 10-11, may be sized to at least span a distance between the pair of elongated support brackets 214. The at least one elongated cross member 216 rests on the top edge 215 of each of the pair of elongated support brackets 214 during use of the modular system 200.

The at least one elongated cross member 216 may have a pair of downwardly facing end stops 252 disposed on a bottom edge of the elongated body such that the end stops 252 extend beyond the plane of the elongated body and are positioned beyond or on the outer surfaces of the elongated support brackets 214, thereby preventing movement of the at least one cross member 216 normal to the direction of the elongated support bracket 214. The downwardly facing protrusions 252 may be formed integral to at least one elongated cross member 216.

The at least one elongated cross member 216 may be positioned at a distance from one edge of the elongated body of the bracket 214.

As seen in FIGS. 10 and 11, the at least one elongated cross member 216 may include a cavity 260 defined on one surface thereof throughout the length of the at least one elongated cross member 216. The cavity 260 may have a concave shape in a direction normal to the length of the at least one elongated cross member 216. The concave shape may be sized such that the at least one article is at least partially disposed within the cavity 260 and thereby restrained from movement past the longitudinal edges of the elongated cross member 216. Preferably, such cavity 260 defines a generally U-shaped cross-section of the at least one elongated cross member 216. This embodiment provides a label view with the article 12 that is displayed and/or stored is a bottle.

In an alternative embodiment, at least one elongated cross member 216 may be a pair of elongated cross members 216 and the magnetic protrusion 250 may be at least a pair of magnetic protrusions 250 spaced apart in relationship with each other. The at least a pair of magnetic protrusions 250 may fix the pair of elongated cross members 216 in a spaced apart parallel relationship with each other by magnetically connecting to an outer surface of the elongated cross members 216. The pair of elongated cross members 216 position a length of the at least one article 12 generally normal to the pair of elongated cross members 216, whereby one end of the at least one article 12 is supported on one of the elongated cross members 216 and another end of the at least one article 12 is supported on another one of the pair of elongated cross members 216. The pair of elongated cross members 216 positioned by the pair of magnetic protrusions 250 orient a length of the at least one article along lengths of the pair of elongated cross members 216, wherein one longitudinal edge of each of the pair of elongated cross members 216 abuts a surface of the at least one article 12.

In one embodiment, the magnetic protrusions 250 can be affixed to the exterior surface of the elongated cross members 216 at locations generally aligned with tabs 224, 226.

Instant invention contemplates that the end stops 252 may be optional elements wherein the magnetic protrusions 250 restrict movement of the elongated cross members 216 in the direction normal to the length of the bracket 214.

Thus, the instant invention provides a novel arrangement for storing and displaying articles that affords the user to economically and effectively arrange the articles 12 in accordance with personal styles or needs and overcomes the disadvantages of conventional storage systems.

For example, if the system 10 is to be used only for storage purposes, user may choose the arrangement of FIG. 4 or 5 so as to maximize the available storage space.

Although the present invention has been shown in terms of modular system for storing and displaying wine bottles, it will be apparent to those skilled in the art, that the present invention may be applied to other articles and items.

The instant invention also contemplates that elongated cross members 16 and various support brackets may be utilized independently from each other in other systems. For example, brackets 14 may be employed with conventional storage system utilizing wire shelves.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A modular system for at least one of displaying and storing at least one article, said modular system comprising:

(a) at least a pair of elongated support brackets disposed in a spaced apart parallel relationship with each other, each support bracket comprising:

i. a body;

ii. a first end of said body configured for attachment to a mounting member employed within said modular system; and iii. at least one magnetic protrusion extending from a top edge of said elongated support bracket;

(b) at least one elongated cross member being sized to at least span a distance between said at least pair of elongated support brackets, said at least one elongated cross member at least resting on the top edge of each of said at least said pair of elongated support brackets during use of said modular system, wherein said at least one magnetic protrusion on each of said elongated support bracket magnetically connects with an outer edge and/or surface of said at least one elongated cross member such that said at least one elongated cross member is restrained from movement along a longitudinal axis of said each elongated support bracket; and (c) means for positioning each of said at least one elongated cross member and said at least said pair of elongated support brackets in a generally horizontal plane during use of said modular system.

2. The modular system of claim 1, wherein said at least one elongated cross member includes a pair of downwardly facing end stops disposed, during use of said modular system, on a bottom surface of said at least one elongated cross member and spaced apart so as to be positioned on or adjacent outer surfaces of said elongated support brackets, whereby said at least one elongated cross member is restrained from movement normal to the longitudinal axis of said each support bracket.

3. The modular system of claim 1, wherein said at least one elongated cross member includes a cavity defined on one surface thereof throughout the length of said at least one elongated cross member, whereby said cavity has a concave shape in a direction normal to a length of said cross member, whereby said concave shape being sized such that said at least one article is at least partially disposed within said cavity and thereby restrained from a movement past longitudinal edges of said elongated cross member.

4. The modular system of claim 1, wherein said at least one elongated cross member is at least a pair of elongated cross members and said at least one magnetic protrusion is at least a pair of magnetic protrusions spaced apart in relationship with each other, wherein said at least a pair of magnetic protrusions fixes said pair of elongated cross members in a spaced apart parallel relationship with each other, whereby said pair of elongated cross members position a length of said at least one article generally normal to said pair of elongated cross members, whereby one end of said at least one article is supported on one of said elongated cross members and another end of said at least one article is supported on another one of said pair of elongated cross members, whereby said pair of elongated cross members positioned by said pair of magnetic protrusions orient the length of said at least one article along lengths of said pair of elongated cross members, wherein one longitudinal edge of each of said pair of elongated cross members abuts a surface of said at least one article.

5. A bracket for supporting a pair of elongated cross members of a modular system for at least one of displaying and storing at least one article, said bracket comprising:

(a) a body;

(b) a first end of said body configured for attachment to a mounting member employed within said modular system;

(c) a first magnetic protrusion disposed, during use of said bracket, above a top surface of said body at said first end thereof, said first magnetic protrusion magnetically connects with an outer surface of one of the pair of elongated cross members and restrains the one of the pair of elongated cross members from a movement along a longitudinal axis of said bracket; and (d) a second magnetic protrusion disposed above said top surface of said body at a second end thereof, said second magnetic protrusion magnetically connects with an outer surface of another one of the pair of elongated cross members and restrains the another one of the pair of elongated cross members from a movement along said longitudinal axis of said bracket.

6. The bracket of claim 5, wherein each of said first and second magnetic protrusions is formed integral to said body of said bracket.

7. The bracket of claim 5, wherein each of said first and second magnetic protrusions is affixed to said body of said bracket.

8. The bracket of claim 5, wherein said bracket includes a pair of tabs extending outwardly from said top surface of said body and wherein each of said first and second magnetic protrusions is affixed to a respective one of said pair of tabs.

9. The bracket of claim 5, further including a third magnetic projection disposed on said top surface of said body mediate said first and second magnetic projections.

10. A modular system for at least one of displaying and storing at least one article, said modular system comprising:

(a) a pair of support brackets spaced apart in a horizontal plane during use of said modular system, each of said pair of support brackets including:

i. a body, and ii. a first end of said body configured for attachment to a mounting member employed within said modular system;

(b) a pair of elongated cross members supported on said pair of support brackets during use of said modular system;

(c) a pair of first magnetic protrusions, each first magnetic protrusion disposed, during use of said modular system, above a top surface of said body at said first end thereof, said each first magnetic protrusion magnetically connects with an outer edge of one of said pair of elongated cross members and restrains said one of said pair of elongated cross members from a movement along longitudinal axes of said pair of brackets; and (d) a pair of second magnetic protrusions, each second magnetic protrusion disposed, during use of said modular system, above said top edge of said respective body at a second end thereof, said each second magnetic protrusion magnetically connects with an outer edge of another one of said pair of elongated cross members and restrains said another one of said pair of elongated cross members from said movement along said longitudinal axes of said pair of brackets.

11. The modular system of claim 10, wherein each of said pair of elongated cross members includes a cavity defined in one surface thereof throughout a length of said each elongated cross member, whereby said cavity has a concave shape in a direction normal to said length of said each elongated cross member, whereby said concave shape is sized such that said at least one article is at least partially disposed within said cavity and thereby restrained from a movement past longitudinal edges of said each elongated cross member.

12. The modular system of claim 11, wherein said cavity defines a generally U-shaped cross-section of said each elongated cross member in said direction normal to said length thereof.

13. The modular system of claim 10, wherein each of said pair of elongated cross members includes a pair of end stops upstanding on one surface of said each of said pair of elongated cross members and facing downwardly during use of said modular system.

14. The modular system of claim 10, wherein said each of said pair of brackets includes a pair of tabs extending outwardly from said top surface of said body and wherein each of said pairs of first and second magnetic protrusions is affixed to a respective one of said pair of tabs.

15. The modular system of claim 10, wherein each of said pairs of first and second magnetic protrusions is affixed to a surface of a respective elongated cross member.

* * * * *